US005783900A

United States Patent [19]

Humphries, Jr. et al.

[11] Patent Number: 5,783,900

[45] Date of Patent: Jul. 21, 1998

[54] LARGE-AREA ELECTRON IRRADIATOR WITH IMPROVED ELECTRON INJECTION

[75] Inventors: Stanley Humphries, Jr., Albuquerque, N. Mex.; Ralph D. Genuario, Alexandria, Va.

[73] Assignee: Virginia Accelerators, Inc., Alexandria, Va.

[21] Appl. No.: 710,817

[22] Filed: Sep. 23, 1996

Related U.S. Application Data

[60] Provisional application No. 60/004,037 Sep. 21, 1995.

[51] Int. Cl.[6] ..... H01J 29/70; H01J 1/46; H01J 21/10; H01J 29/46

[52] U.S. Cl. ..... 313/420; 313/299; 313/302; 313/304; 313/348; 313/447

[58] Field of Search ..... 313/348, 356, 313/420, 441, 447, 351, 448, 299, 300, 301, 302, 304; 315/500, 85, 157

[56] References Cited

U.S. PATENT DOCUMENTS

| | | | |
|---|---|---|---|
| 3,863,163 | 1/1975 | Farrell et al. | 313/447 X |
| 3,956,712 | 5/1976 | Hant | 313/420 X |
| 4,048,534 | 9/1977 | Brewer et al. | 313/420 X |
| 4,061,944 | 12/1977 | Gay | 313/420 |
| 4,079,328 | 3/1978 | Cleland et al. | 313/420 X |
| 4,873,460 | 10/1989 | Miram et al. | 313/420 X |
| 4,952,814 | 8/1990 | Huntzinger | 313/420 X |
| 5,489,783 | 2/1996 | Kristiansson | 313/420 X |

*Primary Examiner*—Sandra L. O'Shea
*Assistant Examiner*—Mack Haynes
*Attorney, Agent, or Firm*—Trapani & Molldrem

[57] ABSTRACT

A broad-beam high energy electron accelerator has an electron injection section arranged for increased current density with greater uniformity and higher transmission through the foil exit window. A plurality of cathode rods are disposed in a transverse plane and spaced at about 2.4 cm, and a reflector plate behind the cathode rods is biased negative relative thereto. A planar control grid is disposed distal of said cathode rods and a screen grid is disposed parallel to and distal of the control grid. Field-shaping wires are disposed in a plane parallel to the plane of the cathode rods and between the same and the reflector plate, with the respective field-shaping wires being disposed parallel to said rods and midway between them. The same positive bias (e.g., 11 kV) is applied to both the control grid and the field-shaping wires.

10 Claims, 5 Drawing Sheets

LARGE-AREA ELECTRON IRRADIATOR WITH IMPROVED ELECTRON INJECTION

This application claims priority of Provisional Patent Application Ser. No. 60/004,037, filed Sep. 21, 1995, and which is incorporated herein by reference.

BACKGROUND OF THE INVENTION

This invention relates to an electron gun of a large-area irradiator. The invention is more particularly with an improved electron gun design to achieve maximum current density and beam uniformity within the constraints set by the properties of thermionic emitters and constraint on the geometry of system. The construction and design of this electron gun are based on calculations performed with EGUN, a steady-state ray tracing code that accounts for self-consistent effects of space-charge and beam-generated magnetic effects. The electron gun (if this configuration generates planar beams from extended arrays of rod cathodes. The electron gun makes effective use of the emission area of the rod cathodes, such that almost 80 percent of the available current appears as a uniform current density sheet electron beam.

The electron gun of this invention is of particular utility in large-scale emission control facilities, such as employed in the e-SCRUB program, which is described in U.S. Pat. No. 5,695,616, Dec. 9, 1997, and that patent is incorporated in here by reference with permission of the assignee thereof. There, high-average-power electron beams catalyze reactions for the removal of nitrous oxides and sulfur diode from the flue gases of coal-burning power plants. e-SCRUB uses pulsed power technology for the economical generation of 800 keV, high-flux electron beams.

High-average power electron beam generators of present design have not achieved the required levels of power and efficiency needed for emission control applications. The conventional design of electron gun employs an array of parallel cathode rods, and an internal grid arrangement is used to bend the paths of the emitted electrons so that they are, in the ideal, perpendicular to the exit window and of generally uniform density. The design of a conventional broad beam electron gun is shown in Farrell et al. U.S. Pat. No. 3,863,163. These guns use an arrangement of hemi-cylindrical control grids having their longitudinal axis coincident with the axis of the respective cathode rods. These control grids are biased a few kilovolts positive relative to the cathode rods. Then there is a screen of parallel wires distal of the cathode rods and control grids. The object of this design was to draw the emitted electrons from the front (distal) side of the cathode rods, spread them uniformly and bend their paths so that they pass at right angles to the exit plane through the exit window into the space to be irradiated. This also minimizes the collisions of the electrons with the hibachi structure that supports the foil at exit window.

In the current electron gun construction, electrons that are emitted from the side or back of the cathode rods can actually cross through the hemi-cylindrical control grids multiple time, and on some paths four times. This means that a relatively high number of electrons are intercepted by the control grids, and that many electrons leave the emitter structure at a rather steep angle, which creates disuniformities at the anode, and leads to collisions with the hibachi structure.

OBJECTS AND SUMMARY OF THE INVENTION

Accordingly it is an object of this invention to provide a broad area high power electron gun suitable, e.g., for use in electron-beam based scrubbing applications, and which avoids the drawbacks of the prior art.

It is another object of the present invention to provide an electron beam with improved electron emitter structure so that a higher fraction of the applied power results in the emission of energetic electrons.

It is a further object of this invention to provide an electron beam generator with improved control grid structure.

According to an aspect of the invention, in an improved large-area electron irradiator, an electron emitter portion generates a broad beam of electrons and includes a planar array of cathode rods and field shaping electrodes to align paths of the emitted electrons in a proximal-distal axis. An anode positioned distally of said emitter portion includes a foil exit window that permits high velocity electrons to pass through and a hibachi supporting structure comprising an array of ribs for supporting the foil exit window. An acceleration gap is defined between the emitter and said anode portions. A stalk or stem of the irradiator carries appropriate electrical voltages that are applied to the cathode rods and the field shaping electrodes. In the improved structure of this invention, cathode rods disposed are in a plane transverse to the proximal-distal axis and are spaced at a predetermined interval (e.g., 2 cm) from one another in this plane, and a reflector plate disposed proximally (e.g., about 2 cm) of the cathode rods is biased negative relative to the cathode rods. A plurality of field-shaping wires disposed in a plane parallel to the plane of the cathode rods and is situated between the same and said reflector plate. The respective field-shaping wires are disposed parallel to the cathode rods and midway between successive ones of the cathode rods. In one preferred embodiment, the plane of the field-shaping wires is about 0.4 cm to 0.6 cm to the proximal side of the cathode rod plane. A planar control grid is situated in a plane distal of the cathode rods (e.g., about 8 to 10 mm). The field sharing wires and the control grid are both biased positive relative to the cathode rods, and in one preferred embodiment, the field-shaping wires and the control grid are both biased about +11 Kv. A planar screen grid is situated a short distance distal of the control grid, and is biased somewhat positive relative to the control grid, e.g., about +12 Kv to +13 Kv relative to the cathode rods.

This improved structure for the emitter portion of the electron gun increases the steepness of the electron paths leaving the emitter portion and arriving at the anode, so that a high fraction of the electrons generated by the cathode rods actually are transmitted through the anode exit window. This structure also reduces the fraction of emitted electrons that are physically intercepted by the grid structure.

The above and many other objects, features, and advantages of this invention will become apparent to those skilled in the art from the ensuing detailed description of a preferred embodiment, which should be considered in conjunction with the accompanying Drawing.

DETAILED DESCRIPTION OF A PREFERRED EMBODIMENT

Figure 1:
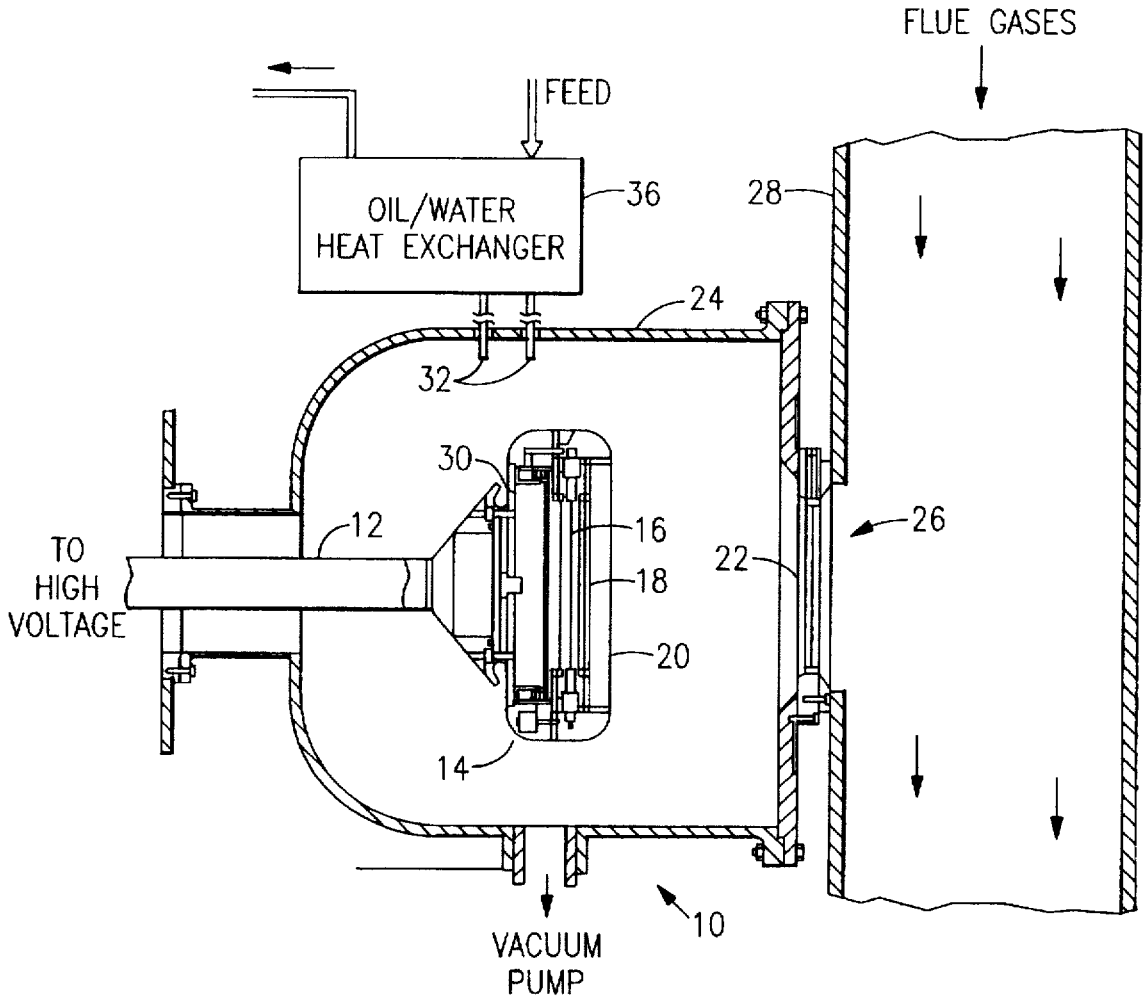
FIG. 1 is a sectional elevation of an electron gun which may incorporate the advantageous improvements of this invention.

With reference initially to FIG. 1 of the Drawing, a broad-beam electron gun or accelerator 10 is designed to be highly reliable, cost effective, and efficient. Moreover, the accelerator 10 must be able to produce an even electron beam intensity over a fairly broad area, i.e., 625 kW for an area of 25 cm by 100 cm, scalable to 1.25 MW for an area of 25 cm by 200 cm. The accelerator or gun 10 of this embodiment is of a double-grid tetrode design, similar in many ways to an electron beam accelerator that is described in Farrell et al. U.S. Pat. No 3,863,163. However, in this case, the accelerator 10 is operated at 1.25 MW in a pulsed mode as opposed to dc operation. As shown in these Drawing figures, the acceleration direction, referred to a forward or distal, is to the right. The back or proximal direction is to the left.

Here, a cathode support arm or stalk 12 supports a cathode housing 14 at its distal end. The cathode housing includes front and back field shaper elements, not shown here in detail. A planar array of thermionic cathode rods 16 are supported side by side in the cathode housing 14. Here one cathode rod is shown oriented in the plane of the Drawing figure. In practice these are thoriated tungsten rods and are spaced about two cm apart over the length of the cathode. A first grid 18 of 92.2% transparent molybdenum mesh serves as control grid, and a second similar mesh 20 serves as screen grid and is at a slightly higher potential than the control grid 18. The screen grid 20 shields the high field regions of the gun 10 from hot emitting surfaces, and also capacitively decouples the control grid from an anode 22 that is disposed distally of the cathode housing 14. Here, the anode comprises a metal film that is transparent to high energy electrons, and can preferably include thin supporting anode ribs, i.e., a so-called hibachi structure, so that the foil anode is at least 90% transparent. The foil support-structure can be a beryllium copper alloy, with the ribs fabricated out of skived BeCu alloy and electron-beam welded to incorporate internal cooling passages. The anode foil comprises an 8022 aluminum alloy foil, which can be rolled to a thickness of about 75 μm and can include alternate layers of TiN and ZrN. In this implementation, two hundred paired layers are used, each layer of 100 Å thickness, with a total coating thickness of 3.0 μm ±0.3 μm. This coating, which gives the anode foil 22 a hardness index greater than that of tungsten carbide and is impervious to mixtures of concentrated nitric and sulfuric acid, adheres very strongly to this aluminum alloy. This coating prevents direct contact with concentrated nitric and sulfuric acids, which is the principal cause of foil corrosion of electron beam windows in an electron beam dry scrubbing process.

The accelerator 10 preferably produces its beam with an average current density of 250 $\mu A/cm^2$, over an anode area of about 25 cm by 100 cm or 50 cm by 100 cm.

Here, a vacuum housing 24 contains the cathode housing 14, and a front or distal wall of the vacuum housing holds the foil support structure (anode) 22 and an anode window 26 that opens into a chamber or conduit 28, where the electron beam acts on some chemical medium, e.g., stack gases from a fossil-fuel generating plant. Electrons generated by the cathode rods 16 propagate forward and are accelerated towards and through the anode 22 and into the flue gases passing through the conduit 28 past the window 26 As aforesaid, the accelerator 10 is preferably operated in a pulse mode. The control grid 18 operates to pass only the electrons that are sufficiently energetic to traverse the foil anode 22. This limits the number of electrons that are absorbed in the anode or in the supporting hibachi structure, and thus reduces the amount of thermal energy present in the anode. Also, the control grid 18 eliminates one of the prime causes of anode foil fatigue, namely the deposition of low energy electrons on the front surface of the foil. Low energy electrons can induce a large thermal shock in the foil on each pulse, regardless of what foil is employed, and this will eventually lead to anode foil failure. However, by timing the grid 18 to gate only during the high energy (above 250 keV) portion of the accelerating pulse, these low energy electrons are completely eliminated. In addition, divergence in the electron beam will be reduced; this divergence can create concentrations of current density, producing hot spots at the exit window. The beam power in the hot spots can be about twice the average power, increasing the risk of vacuum window damage.

The control grid, disposed close to the cathode rods, controls electron emission into the main acceleration gap. A pulse of 11 kV is sufficient to turn on the electron flow. The cathode grid pulser initiates flow after the cathode support is at full voltage. Furthermore, the grid pulse length is somewhat shorter than the main voltage pulse. This arrangement prevents injection of low energy electrons into the vacuum window. The main acceleration gap between the cathode grid and the vacuum window is about 30 cm wide. At 800 kV, the relativistic space-charge limited current density is 1.58 $A/cm^2$. Electrons attain relativistic energies in the acceleration gap. The main acceleration gap therefore operates in the source-limited mode with current density controlled by the electron injector elements. Because of the cathode and grid structure, the injected electrons have large angular divergence in the horizontal direction. However, there is minimal angular spread in the direction parallel to the cathode rods.

The accelerator 10 is liquid cooled, and some of the cooling coils, namely cooling tribes 30 are shown here positioned on the rear portion of the cathode housing 14. Additional cooling passages can be incorporated elsewhere, for example on the supporting ribs of the foil anode. In some preferred embodiments, water can employed for thermal management of the foil support structure, and a pair of conduits 32, 32 are here shown penetrating the vacuum housing 34 and leading from the cathode housing 14 to a water/water heat exchanger 36. Also in the vacuum housing, an evacuation port leads to a vacuum pumping system (not shown).

To prevent damage to the vacuum window, the current density is limited to 1.25 $A/cm^2$. The total accelerated current is about 3 kA per 25 cm by 100 cm electron gun. At a repetition rate of 667 Hz, the time -averaged power of the accelerator 10 is about 0.5 MW. Approximately ten percent of the current strikes the hibachi structure that provides mechanical support for the thin vacuum window 22. The hibachi typically consists of a series of vertical beryllium copper bars of horizontal width 0.14 cm spaced 1.32 cm center-to-center. The bars extend 1.27 cm along the direction of beam propagation. Thermionic cathodes are essential for continuous pulsed operation. The cathode rods 16 are 2.5 mm tungsten rods oriented in the vertical direction spaced 2.4 cm apart horizontally. Thermal management in the vacuum system limits the cathode heater power to about 0.8 kW, sufficient to maintain a surface temperature over 1800° C. This gives a maximum current density on the rod surfaces of about 6 A/cm$^2$. If electrons were extracted at the source limit over the entire surface of the rod cathode 16, the available current density over a 2.4 cm horizontal width would be 1.83 A/cm$^2$. In this embodiment there are forty-two cathode rods 16, and the rods 16 have a spacing interval of 2.4 cm to stay within their cathode heater power limit.

A grid close to the cathode rods controls electron emission into the main accelerating gap, which is defined between the screen grid 20 and the anode window 22. A pulse of 11 kV is sufficient to turn on the electron flow. The cathode-grid pulser initiates flow after the cathode support is at full voltage. Furthermore, the grid pulse length is somewhat shorter than the main voltage pulse. This arrangement prevents injection of low energy electrons into the vacuum window. The main acceleration gap between the cathode grid and the vacuum window is 30 cm wide. At 800 kV, the relativistic space-charge-limited current density is 1.58 A/cm$^2$. The main acceleration gap therefore operates in the source-limited mode with current density controlled by the injector, defined as the cathode rods, grids, and other cathode structure.

Figure 2:
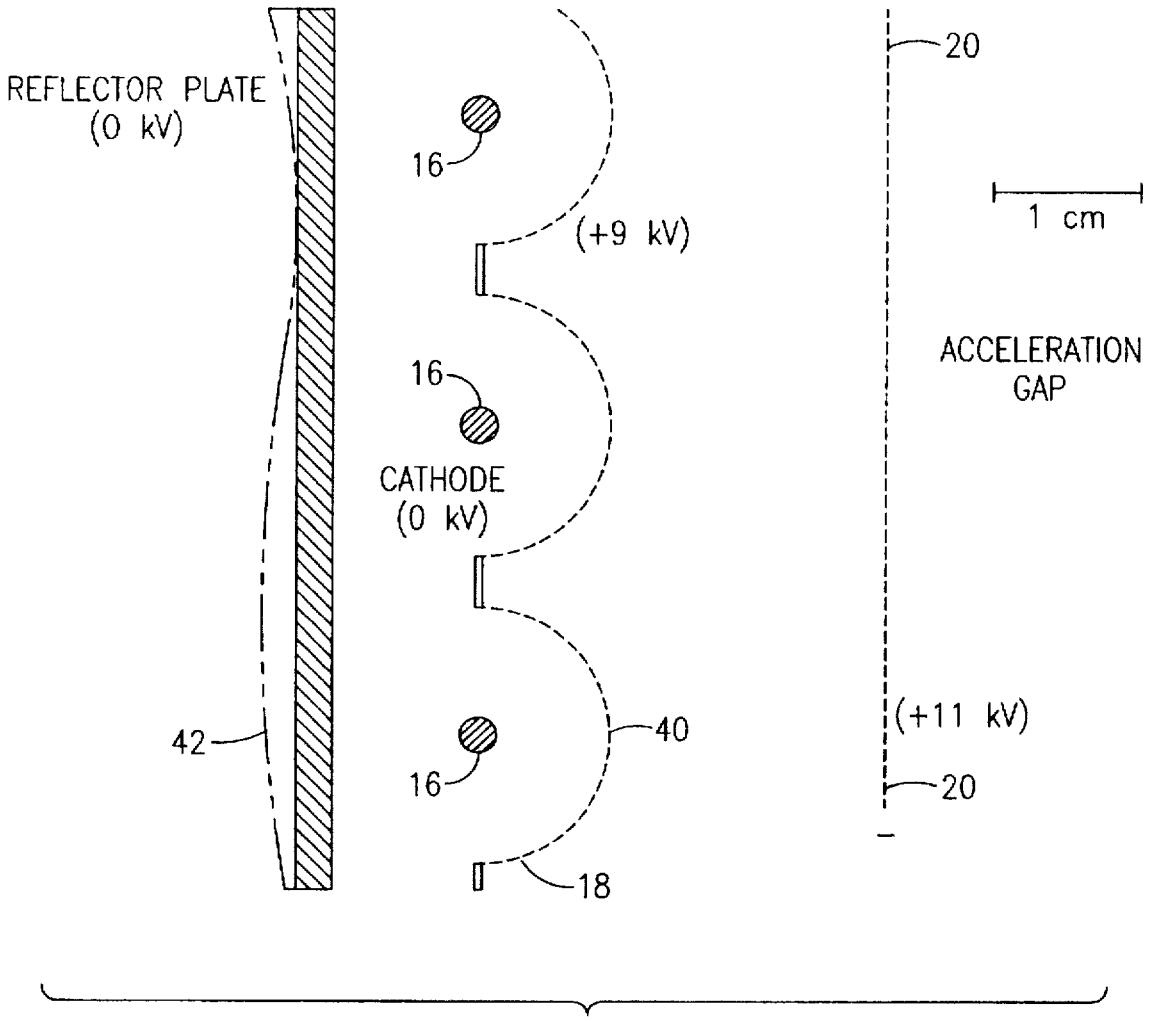
FIG.2 Prior Art
FIG. 2 is a partial sectional view showing the hemi-cylindrical control grid design of the prior art.

The arrangement of the cathode rods 16, control grid 18 and screen grid 20 of the accelerator such as that of the prior Farrell patent is shown in cross section in FIG. 2. This design is known to provide good extracted beam uniformity in the horizontal direction. Here, the cathodes 16 are tungsten rods. The control grid 18 has a hemi-cylindrical shaped cages 40 that are coaxial with the associated rod 16 center axis. These control grid cages wrap around the cathodes 16 about 180° in the forward or distal direction. The purpose of the shaped grid was to extend positive electric fields around the sides and back of the rods. The control grid surface was 1.0 cm from the rod center. A reflection plate 42 is 1.0 cm behind, or proximal of the plan of the cathode rods, and is given a positive 2.5 kV bias to repel any backward-directed electrons. The plate creates electric fields to reflect electrons emitted in the backward direction. The negative voltage also counteracts the small field penetration through the grid meshes during the rise of the acceleration gap voltage to inhibit electron emission. The screen grid 20 is about 2.5 cm forward of the front of the control grid hemi-cylindrical cages 40. The acceleration zone extends from the screen grid proximally to the anode foil (not shown here). Bias potential of +9 kV is applied to the control grid 16 and bias potential of +11 kV is applied the screen grid 20.

To prevent damage to the vacuum exit window, the current density is limited to 1.25 A/cm$^2$. The total accelerated current is about 3 kA. At a repetition rate of 667 Hz, the time averaged power of an acceleration unit is about 0.5 MW. Approximately ten percent of the current strikes the hibachi structure that provides mechanical support for the thin foil exit window. The hibachi consists of a series of vertical molybdenum bars of horizontal width 0.14 cm spaced 1.32 cm center-to-center. The bars extend 1.27 cm along the direction of beam propagation. Thermionic cathodes are essential for continuous pulsed operation. Thermal management in the vacuum system limits the cathode heater power to about 9 kW, sufficient to maintain a surface temperature of the rods 16 over 1800° C. This gives a maximum current density on the rod surfaces of about 6 A/cm$^2$. If electrons were extracted at the source limit over the entire surface of the rod cathode, the available current density averaged over a 2.4 cm horizontal width would be 1.83 A/cm$^2$. However, most of the electrons emanate from the forward or distal side of the rod, and fewer from the back or proximal side.

Figure 3:
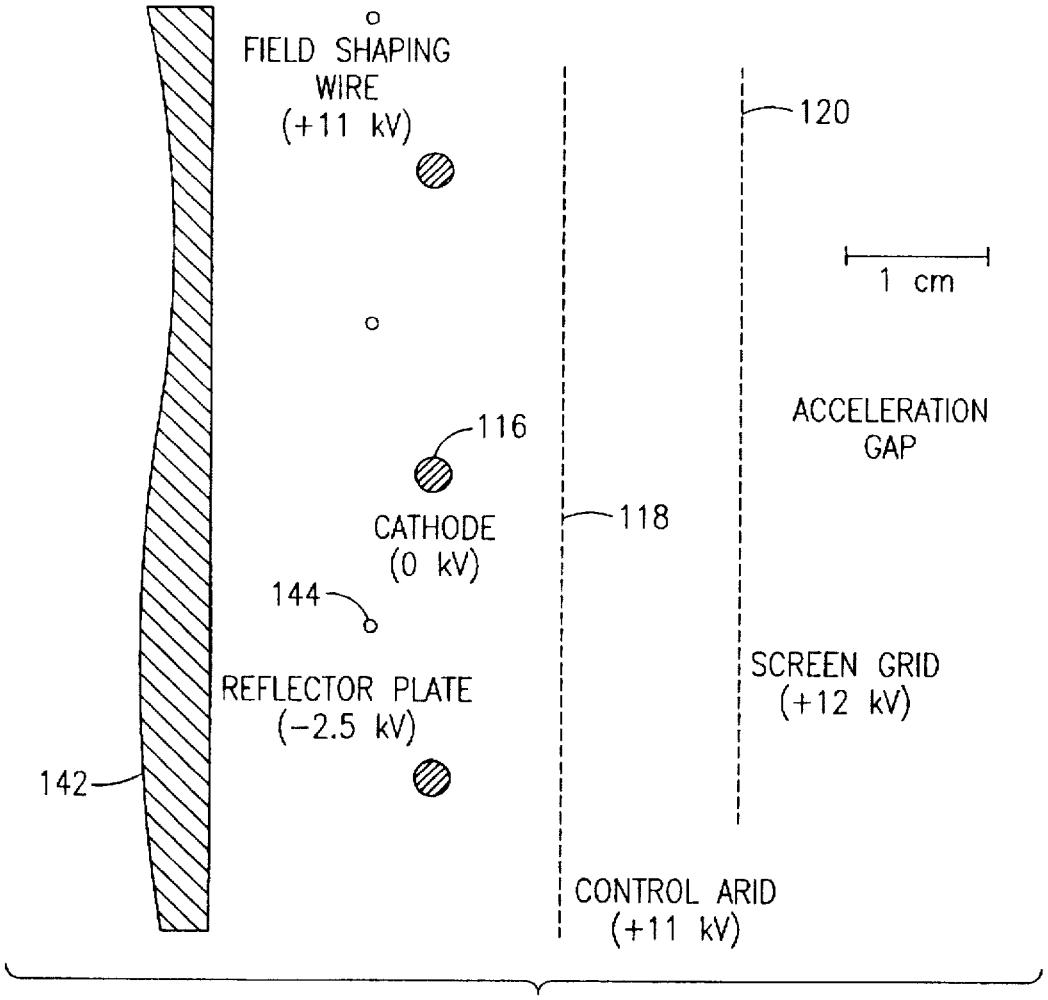
FIG. 3 is a partial sectional view showing the planar field-shaping wire structure and planar control grid structure according to a preferred embodiment of this invention.
Figure 4:
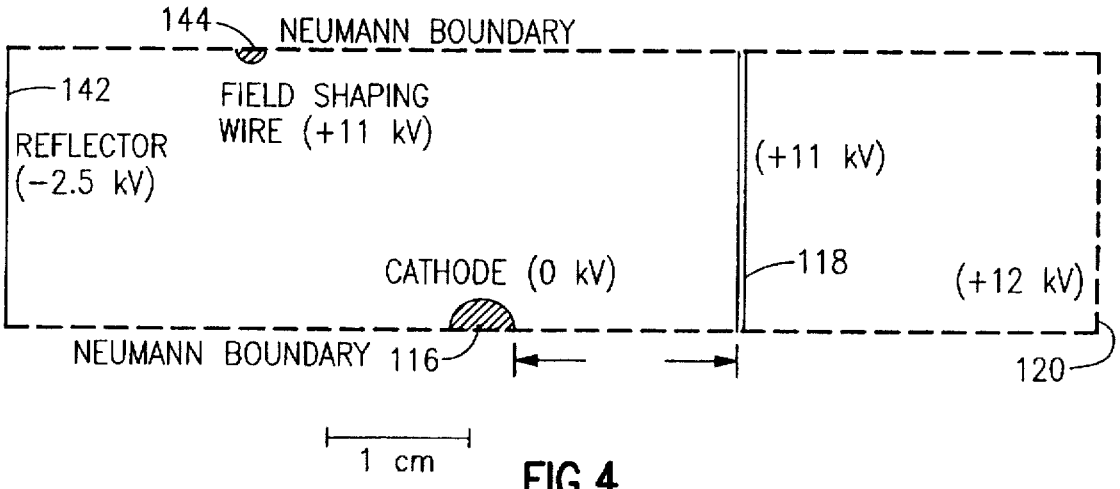
FIG. 4 is a two-dimensional half-cell representation of a portion of this embodiment for considering the paths of electron paths from the cathode rods to the screen grid.

The improved arrangement according to an embodiment of this invention is shown in the detail views of FIGS. 3 and 4. Here, the elements corresponding to those shown in FIG. 3 are identified with the same reference numbers, but raised by 100. Here the cathodes are thoriated tungsten cathode rods 16 having a diameter of about 2.5 mm, and arrange spaced parallel to one another in a common plane. This embodiment employs a planar mesh control grid 118 spaced about eight to ten mm distal of the plane of the centers of the cathode rods 116. The rods 116 are about 2.5 mm in diameter. The planar control grid 118 is biased about 11 kV positive. The screen grid is spaced distal of the control grid and is biased about 12 kV positive. The reflector plate 142 is situated about 1.0 cm behind the plane of the cathode rods, and is biased about 2.4 kV negative.

A standard arrangement for grid-controlled electron devices is to pulse the cathode negative with respect to the control grid 18 to initiate electron flow (grounded grid configuration). Because of the fast pulse and the long length of the cathode support stalk 12 through the linear induction transformer, the grounded grid configuration is not possible. For a good control pulse shape and uniform extracted current, it is necessary to locate the grid driver inside the cathode housing. This precludes the use of high-power isolation transformers to supply a low-voltage heater current. As a result, the cathode rods must be at a potential close to that of the housing. In this case, electron emission is initiated by pulsing the control grid 118 to a positive voltage. This arrangement poses a problem—if the control grid is exposed to the high voltage pulse of the acceleration gap, the coupling capacitance will drive a large current through the grid circuit. For that reason the double grid configuration, including the screen grid 20 is employed. The emission surface grid and focusing electrode at the forward position are biased +12 kV relative to the body of the housing and the rod cathodes. These electrodes connect to the housing through low inductance capacitors that maintain the relative bias potential during the rise and fall of the main voltage pulse. The control grid 118, normally at the same potential as the cathode rods 116, is pulsed to +11 kV to initiate electron flow.

As a means to control the orbits or paths of the electrons that are emitted from the cathode rods 16, this embodiment is provided with field shaping wires 144 disposed in a plane parallel to the plane of the cathode rods 116 and positioned about 0.3 to 1.0 cm behind or distal of the rods. The field shaping wires 142 are electrically connected to the control grid 118.

Their purpose is to induce positive electric fields on the rear sides of the cathode rods to increase the net extracted current. The improvement in the exit angle of the electrons and in the orbit shapes to avoid collisions with grid structure can be seen by comparing the following plots showing the electron orbits or paths according to the prior art and according to the present invention.

Figure 5:
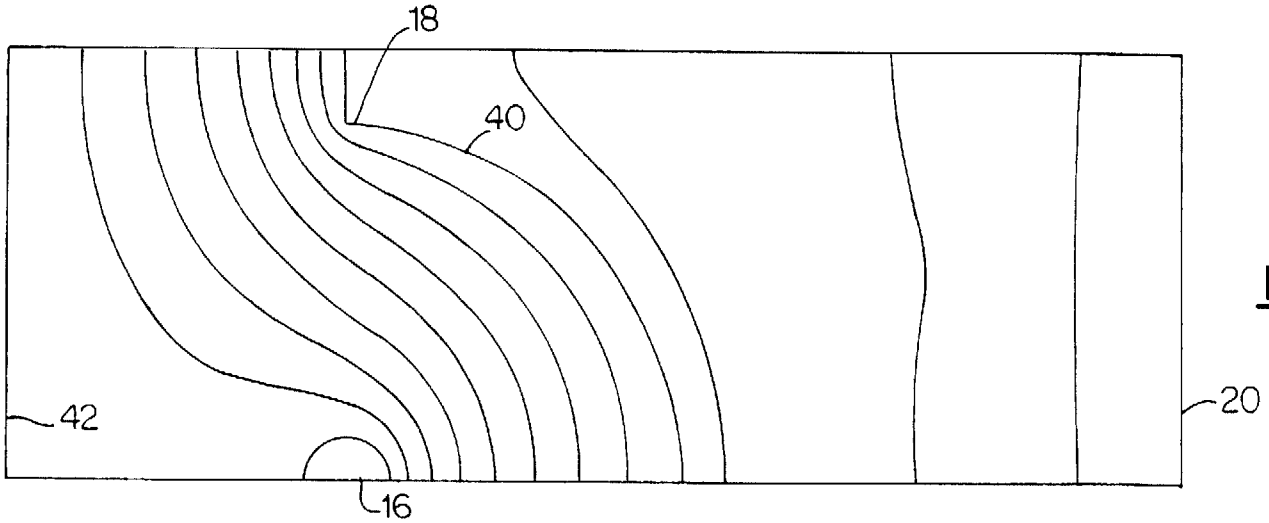
FIG. 5 is a potential field plot of a corresponding half-cell of the prior art design of FIG. 2.
Figure 6:
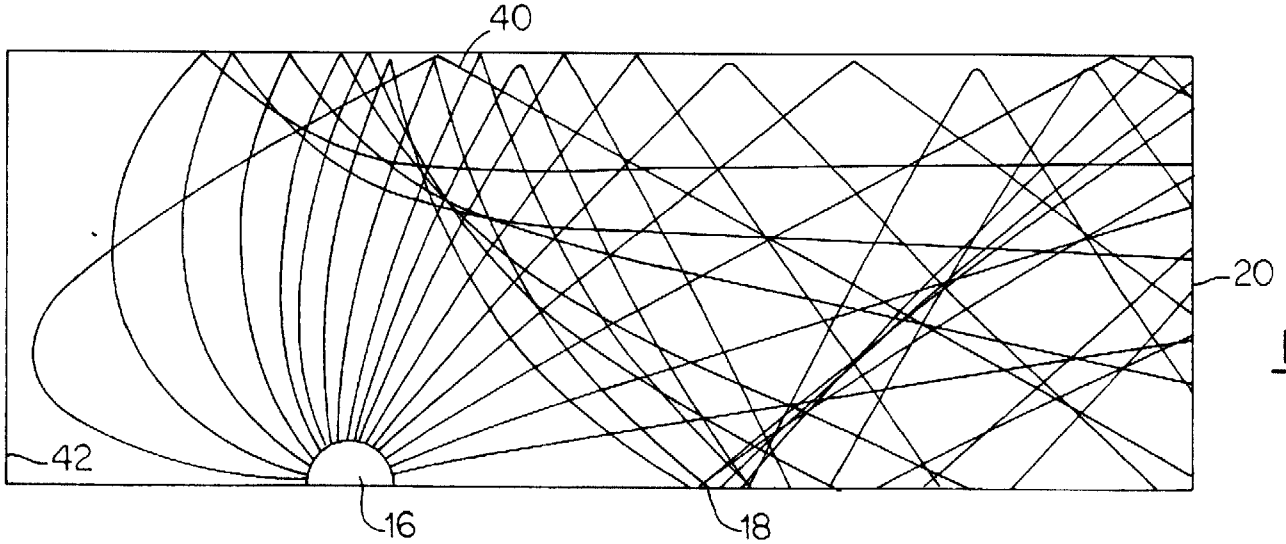
FIG. 6 is a plot of the paths of the emitted electrons in the prior art design of FIGS. 2 and 5.

FIG. 5 shows calculated equipotential lines (at approximately 1 kV intervals) in the configuration of FIG. 2. FIG. 6 shows the self-defined electron orbits for the low-energy electrons emitted from the cathode rods 16 as they travel towards and exit the plane of the screen grid 20. These two views illustrate one half-cell, that is, from the axis of one cathode rod 16 to a plane bidway between it and the next cathode rod 16. Electron emission is limited by space-charge along the rear or distal side of the rod 16. The source limits applied constrained emission from the front side to about 6 A/cm$^2$. The control electrode potential was chosen to generate the target current density at the emission surface within the source limit.

Inspection of FIG. 6 shows that the orbits of electrons emitted from the front face of the cathode rod 16 are simple, while electrons created on the sides and rear followed complex trajectories. Although the beam-generated magnetic field can be rather large, its effect on the electron orbits could be compensated at non-relativistic speeds through judicious re-shaping of the injector structure. The hemi-cylindrical control grid 16 generated a beam with large angular divergence at the screen grid 20. The root-mean-squared value of the divergence is here about 30°. When the control and emission grids were set to the same potential, there was substantial space-charge buildup in the intervening space. This caused reflection of some electrons with large transverse angles. We found it necessary to apply a voltage difference of at least +2 kV between the control and emission grids to extract all available electrons. For the FIG. 2 embodiment, 93 percent of the current leaving the rod passed through the exit plane, i.e., the screen grid. A predicted exit plane current density (averaged in the horizontal direction) would be 1.41 A/cm$^2$. The actual figure would be lower because of grid losses. We can obtain molybdenum mesh with a 92 percent geometry transparency. If all electrons passed through the two grids at normal incident, grid losses would reduce the current by a factor of 0.925 to 1.30 A/cm$^2$. We found (Sect. 4) that the configuration of FIG. 7 gave good beam uniformity at the vacuum window.

Although the hemi-cylindrical grid geometry could produce adequate results, in theory, we anticipated problems in the actual system. The shaped grid would be difficult to fabricate and to support. Most important, an inspection of FIG. 6 shows that the effective transparency of the assembly may be much lower than predicted from the geometric transparency. Electrons emitted in the backward direction passed through the grids at oblique angles. Electrons directed sideways traversed the hemi-cylindrical grids 40 as many as four times. Therefore, the extracted current density level would be significantly degraded.

Figure 7:
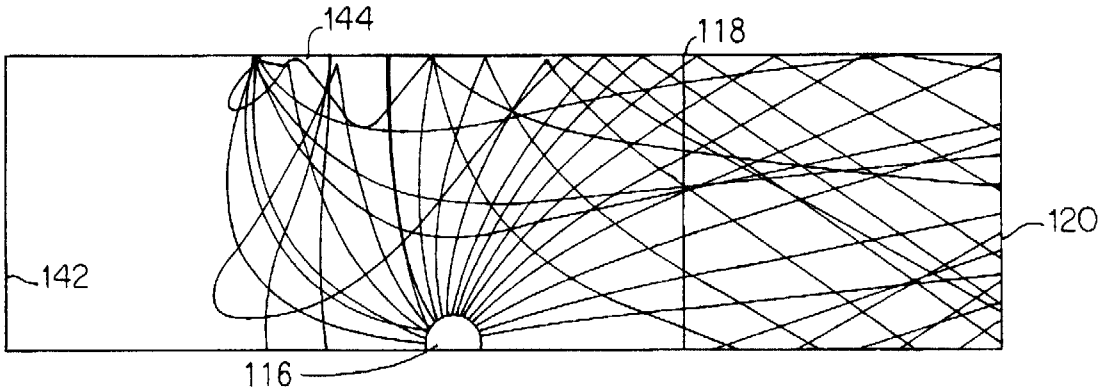
FIG. 7 is a plot of the paths of the emitted electrons in the design of this embodiment.

By way of contrast with the foregoing, FIG. 7 illustrates the electron orbits for the electron emitter structure of this invention, here showing the emitted electron paths or orbits in the half-cell shown in FIG. 4. The influence of the field-shaping wire 144 on the paths of the electrons that emanate from the back side of the cathode rod 1 16 is quite apparent. The cathode emission was governed by both space-charge and source limitation, with a maximum cathode current density of 6 A/cm$^2$. Although the upstream orbits were quite complex, few reflexing electrons were lost to the thin wire 114. By the time the rays reached the two grids they were traveling predominantly in the forward direction, and with very little transverse component. Therefore, the grid transparency for the actual system would be close to the geometric value. Electrons at the emission plane had a root-mean-squared angular divergency of 25°, below the value mentioned just previously for the hemi-cylindrical injector. Because of the improved directionality, there was no problem of electron reflection in the space between the grids. Over 90 percent of the cathode current passed through the emission grid. The average current density was 1.41 A/cm$^2$. With a grid transparency factor of 0.925, the current density is 1.30 A/cm$^2$.

Figure 8:
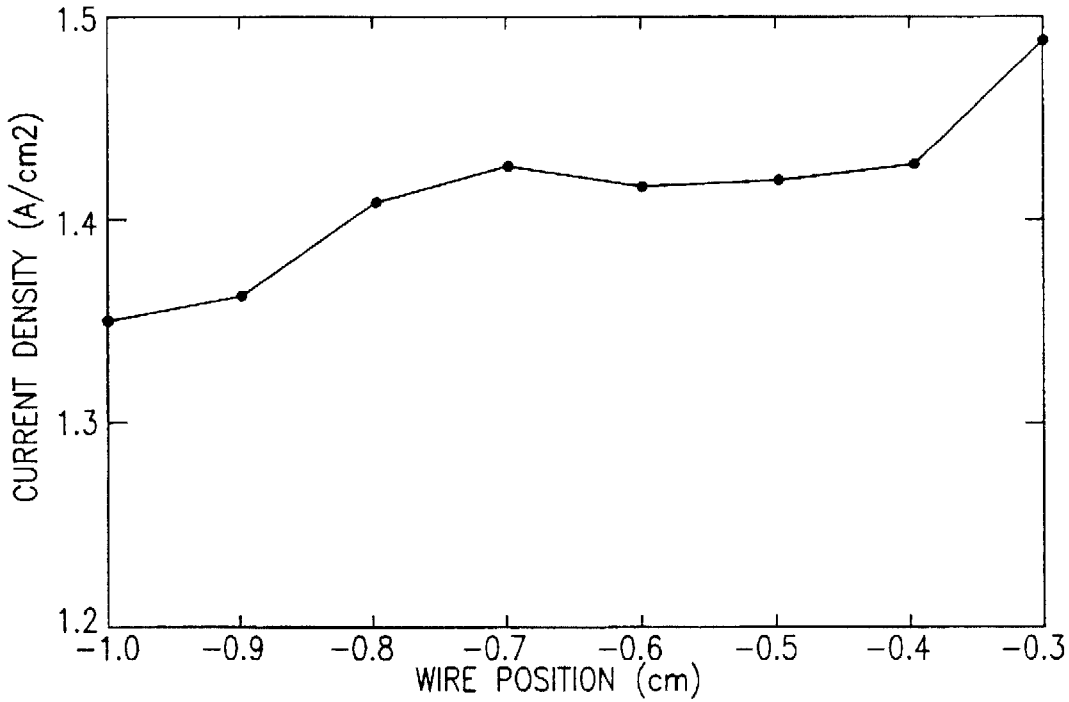
FIG. 8 is a plot of average current density as a function of position of field-shaping wires.

FIG. 8 shows a plot of average current density at the plane of the screen grid 120 versus wire position for the field-shaping wires 144. The distance is measured from the midplane of the cathode rods 116, with the reflector plant at 2.0 cm proximal of the cathode and at −2.5 kV, the control grid 118 1.0 cm distal of the plane of the cathode and at +11 kV, and with the emission grid 2.4 cm and at +12 kV. The plot is at 1 mm intervals, with the field shaping wires parallel to the cathode rods and disposed midway between successive rods. The field-shaping wires 144 have an effective range of between about 0.3 and 1.0 cm, with a preferred region between about 0.6 and 0.4 cm proximal of the cathode plane. The wire position within this range has only a small effect on the electron extraction efficiency. The quantity, equal to the current passing through the exit grid divided by the emitted current, remained between about 0.90 and 0.92 over the full range. On the other hand, the total emitted current increased as the wire 144 was moved forward or distally. The output distribution was best with the wire 144 placed about 0.5 cm behind the cathode plane.

In principle, it would be possible to enhance emission from the back side of the cathode rods 116 by adding more field-shaping wires 144. However, the resultant improvement would be minimal and would not justify the extra constructional difficulty. In the present design, the current at the emission surface is almost 80 percent of the maximum value set by the source limit. Furthermore, extra wires would intercept more electrons.

While this invention has been described in detail with reference to a preferred embodiment, it should be understood that the invention is not limited to that precise embodiment. Rather, many modifications and variations would present themselves to persons skilled in the art without departing from the scope and spirit of the invention, as defined in the appended claims.

We claim:

1. A large-area electron irradiator in which an electron emitter portion generates a broad beam of electrons and includes a planar array of cathode rods and field shaping electrodes to align paths of the emitted electrons in a proximal-distal axis; an anode positioned distally of said emitter portion includes a foil exit window that permits high velocity electrons to pass through and a hibachi supporting structure comprising an array of ribs for supporting said foil exit window; an acceleration gap is defined between said emitter portion and said anode portion; and supply means apply appropriate electrical voltages to said cathode rods and said field shaping electrodes; said emitter portion comprising said plurality of cathode rods disposed in a plane transverse to said axis and spaced at a predetermined interval from one another in said plane;

a reflector plate disposed proximally of said cathode rods and biased negative relative thereto;

a plurality of field-shaping wires disposed in a plane parallel to said cathode rods and between the same and said reflector plate, with the respective field-shaping wires being disposed parallel to said rods and midway between successive ones of said rods;

a control grid disposed in a plane transverse to said axis and distal of said cathode rods; and a screen grid disposed parallel to and distal of said control grid;

said supply means providing said field-shaping wires with a bias that is positive relative to said cathode rods, said control grid with a bias that is positive relative to said cathode rods, and said screen grid with a bias that is positive relative to said control grid.

2. The electron irradiator of claim 1 wherein said field shaping wires are disposed in a plane about 0.3 to 1.0 cm proximal of the plane of said cathode rods.

3. The electron irradiator of claim 2 wherein the plane of the field shaping wires is about 0.4 to 0.6 cm proximal of the plane of said cathode rods.

4. The electron irradiator of claim 1 wherein said field shaping wires and said control grid are biased to the same voltage.

5. The electron irradiator of claim 4 wherein said filed shaping wires and said control grid are biased at 11 kV and said screen grid is biased at 12 kV.

6. The electron irradiator of claim 4 wherein said cathode rods are coupled to support structure and said supply means pulse biases said cathode rods, and biases said control grid and field-shaping wires after the cathode bias pulses are initiated so that the cathode rods initiate electron flow after the cathode support structure is at full cathode voltage.

7. The electron irradiator of claim 1 wherein said control grid is disposed about 8 to 10 mm distal of the plane of said cathode rods.

8. The electron irradiator of claim 1 wherein said reflector electrode is disposed about 2 cm proximal of said cathode rods.

9. The electron irradiator of claim 1 wherein said control grid comprises parallel wires that are oriented perpendicular to both said axis and to said cathode rods.

10. The electron irradiator of claim 1 wherein said anode foil exit window has a support structure formed of beryllium coper ribs, and said foil exit window is made of an aluminum alloy anode material.

* * * * *